US006276000B1

(12) United States Patent
Saman et al.

(10) Patent No.: US 6,276,000 B1
(45) Date of Patent: Aug. 21, 2001

(54) COMBINED STRAINER AND STOPPER FOR BASIN DRAIN

(76) Inventors: Husam Saman; Saman H. Saman, both of 11703 Amkin Dr., Clifton, VA (US) 20124

( * ) Notice: Subject to any disclaimer, the term of this patent is extended or adjusted under 35 U.S.C. 154(b) by 0 days.

(21) Appl. No.: 09/621,650

(22) Filed: Jul. 21, 2000

(51) Int. Cl.[7] ..... E03C 1/262
(52) U.S. Cl. ..... 4/287; 4/295
(58) Field of Search ..... 4/287, 286, 295, 4/680, 679, 288–294, 652

(56) References Cited

U.S. PATENT DOCUMENTS 2,075,443 * 3/1937 Kirschner et al. ..... 4/287
2,429,435 * 10/1947 Vartanian ..... 4/287
3,314,086 * 4/1967 Minella ..... 4/287 X
3,570,022 * 3/1971 Nealy ..... 4/287

* cited by examiner

*Primary Examiner*—Charles E. Phillips
(74) *Attorney, Agent, or Firm*—Dennis H. Lambert

(57) ABSTRACT

A combined strainer and stopper device for basins, sinks and the like. The device has a perforated cylindrical housing having an open lower end and a perforated top wall. An annular valve seat is formed in the lower end, and a handle is affixed to the top wall. A valve disc is reciprocable in the housing into and out of sealing engagement with the valve seat. An actuator stem is connected at a lower end to the valve disc and extends at its upper end through an opening in the handle. Outwardly projecting retaining lugs are on the stem for cooperation with the handle to retain the valve disc in an open position.

6 Claims, 3 Drawing Sheets

COMBINED STRAINER AND STOPPER FOR BASIN DRAIN

BACKGROUND OF THE INVENTION

1. Field of the Invention

This invention relates to devices for preventing clogging of sink or basin drains. More particularly, this invention relates to a combined strainer and stopper for basin drains.

2. Prior Art

The cleaning of cooking and eating utensils, and the preparation of food, e.g., the cleaning and trimming of vegetables and other food products, normally entail the use of a sink or basin in which the items are rinsed with water. This activity results in the accumulation of debris which can clog drains, and this, in turn, frequently leads to the employment of a plumber and the attendant cost associated with unclogging the drain or drains. Moreover, a clogged drain can lead to overflow of soiled water, and damage to other equipment and structure, or at a minimum the need to clean up a mess.

Most sinks have a stopper to close the drain from the sink so that a quantity of water can be accumulated in the sink, and some type of strainer associated with the drain to prevent debris from entering the plumbing and possibly clogging it. In residential environments, these strainers are usually flat or shallow cup shapes, and frequently have a stopper or plug associated with them. While these devices are satisfactory for the intended purpose, they do not have the capacity or functionality to handle large amounts of debris without being cleaned frequently. This is particularly true in commercial environments, i.e., restaurants, where the amount of debris can be quite large. Strainers suitable for residential use are usually not satisfactory for use in these commercial environments.

Moreover, a relatively flat or short strainer and/or stopper which is located wholly within or at the drain from a basin is not accessible without immersing one's hand in the water. Further, in order to effect drainage of the water from the basin, it may be necessary to remove the strainer and stopper. This defeats the strainer function of the device and enables debris to enter the drain.

Strainers and combined strainers and stoppers have been developed in the art to eliminate some of the problems noted above. For instance, U.S. Pat. No. 1,835,447 discloses an elongate strainer and stopper combination wherein an upper end of the device, and particularly the stopper actuator, is accessible above the level of water in the basin. U.S. Pat. No. 1,596,893 also discloses in FIG. 1 a combined strainer and stopper of elongate configuration. The device shown in this patent is invertible so that it performs a straining function in one position, and a stopper function in an inverted position. To convert from one use to the other, it is necessary to remove the device from the drain.

None of the combined strainer and stopper devices known to applicant have an elongate strainer structure which is adapted to rest at one end in a drain opening and extend at its other end a substantial distance above the opening, with a stopper valve reciprocable in the strainer to cooperate with a valve seat in said one end of the strainer to selectively open and close the drain from the basin, whereby the device presents a large strainer area in the basin, and has a stopper which is actuatable to any position while the strainer remains in place in the drain opening.

Accordingly, there is need for such a device.

SUMMARY OF THE INVENTION

A combined strainer and stopper is provided by the present invention, wherein the device has an elongate strainer structure which is adapted to rest at one end in a drain opening and extend at its other end a substantial distance above the opening, with a stopper valve reciprocable in the strainer to cooperate with a valve seat in said one end of the strainer to selectively open and close the drain from the basin, whereby the device presents a large strainer area in the basin, and has a stopper which is actuatable to any position while the strainer remains in place in the drain opening.

The combined strainer and stopper of the invention comprises an elongate, perforated tubular housing with an open lower end and a perforated top wall. A valve seat is formed in the lower end, and a handle is affixed to the top wall and includes a central portion spaced upwardly from the top wall. A stopper valve disc is reciprocable in the housing toward and away from the valve seat, and an elongate valve actuator is connected with the valve disc and has an upper end extending through the handle and accessible above the central portion of the handle. Cooperating detent means are on the actuator and the handle to lock the stopper valve in a raised, open position spaced from the valve seat.

The lower end of the housing is adapted to fit snugly in a drain opening so that the housing is supported in an upright position above the drain opening. When the stopper valve is in a raised position, a large perforated area is available for maximum flow of water while straining debris from the water without becoming clogged. With the stopper valve in a lowered position, the drain is closed so that water is retained in the basin.

BRIEF DESCRIPTION OF THE DRAWINGS

The foregoing, as well as other objects and advantages of the invention, will become apparent from the following detailed description when considered in conjunction with the accompanying drawings, wherein like reference characters designate like parts throughout the several views, and wherein.

DETAILED DESCRIPTION OF THE PREFERRED EMBODIMENT

Figure 2:
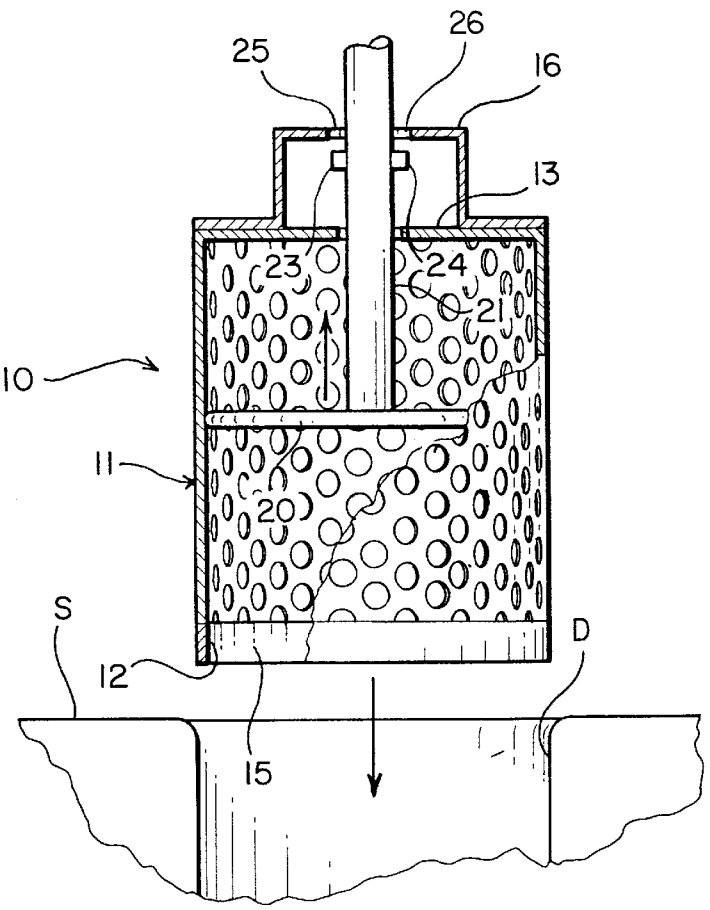
FIG. 2 is a side view in elevation, shown partly in section, of the combined strainer and stopper of FIG. 1 being inserted into a drain opening, and showing the valve stopper in an intermediate, open position.
Figure 1:
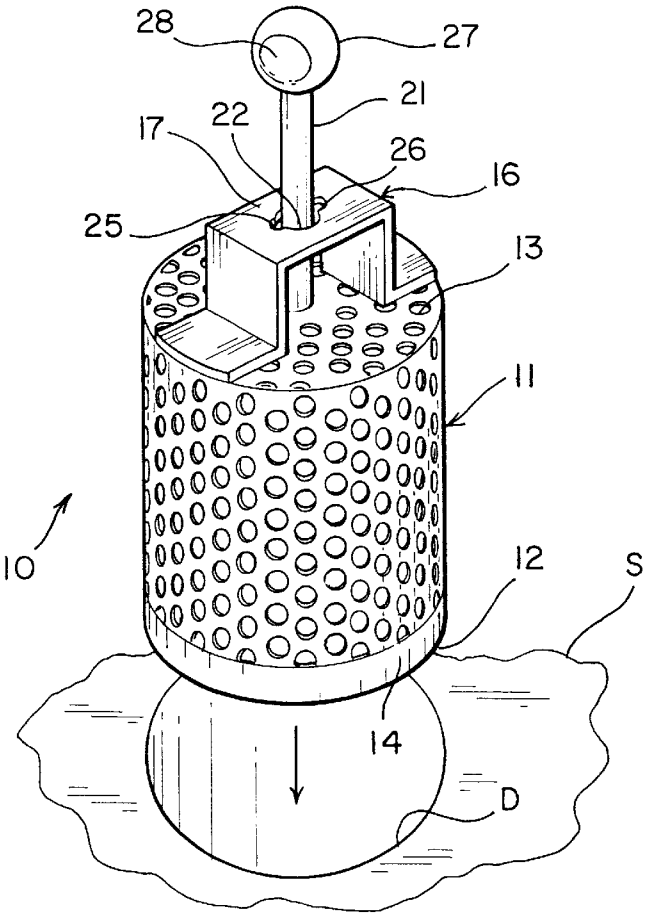
FIG. 1 is a top perspective view of a combined strainer and stopper according to the invention, shown in exploded relationship to the drain opening from a basin, sink, tub or other structure.
Figure 3:
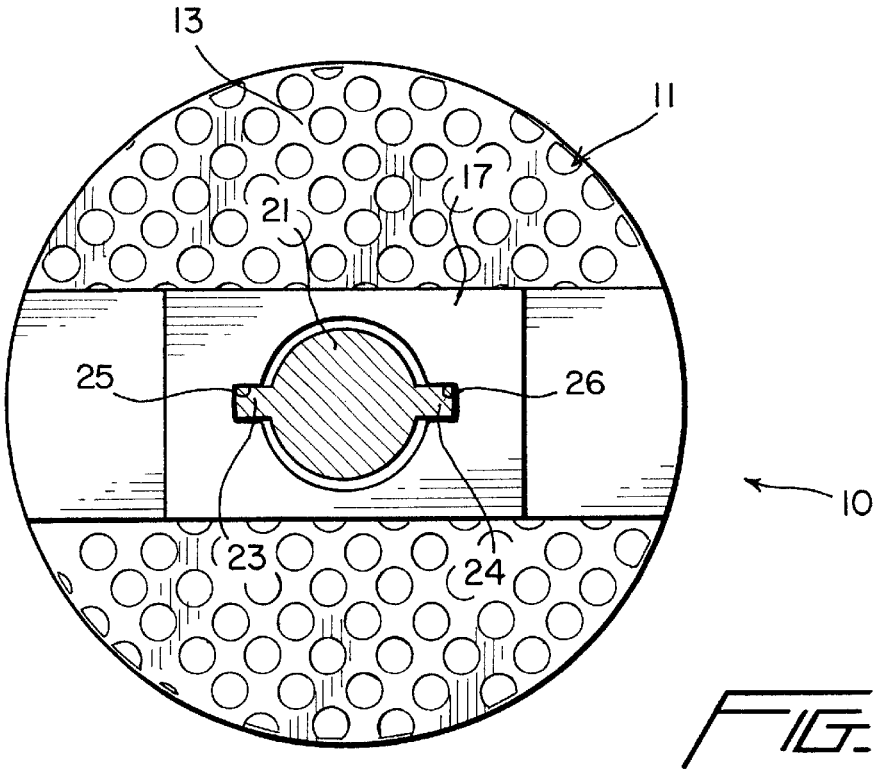
FIG. 3 is a top plan view taken along line 3—3 in FIG. 2, showing the valve actuator in a rotated position so that the retaining lugs thereon can be moved through cooperating slots in the handle on the perforated housing, whereby the actuator and valve stopper can be raised.
Figure 4:
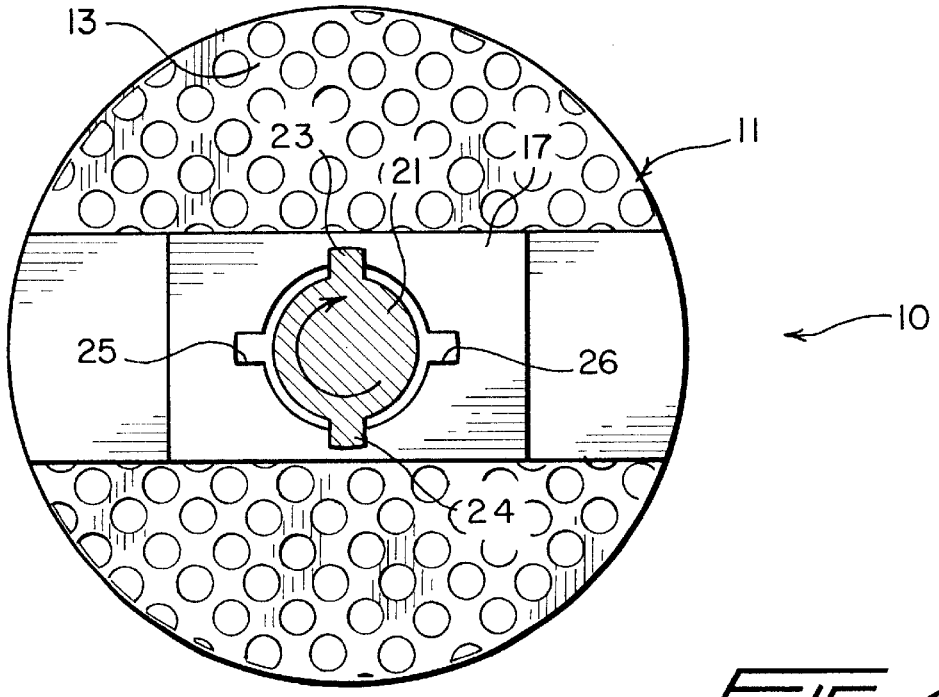
FIG. 4 is a view similar to FIG. 3, but showing the valve actuator in the position it would have if raised and rotated to move the retaining lugs out of alignment with the slots in the handle, whereby the lugs rest on top of the handle to retain the actuator and valve stopper in their raised, open position.

Referring more specifically to the drawings, a combined strainer and stopper device in accordance with the invention is indicated generally at 10 in FIGS. 1–6. The device comprises an elongate, perforated cylindrical housing 11 having an open lower end 12 and a perforated top wall 13. The lower end 12 has a relatively short imperforate section 14 that defines an annular valve seat 15 on the internal surface of the lower end.

A handle 16 is affixed to the top wall, and includes a raised midportion 17 that may be grasped by a person to lift and position the device in a drain opening D of a basin or sink S or the like.

Figure 6:
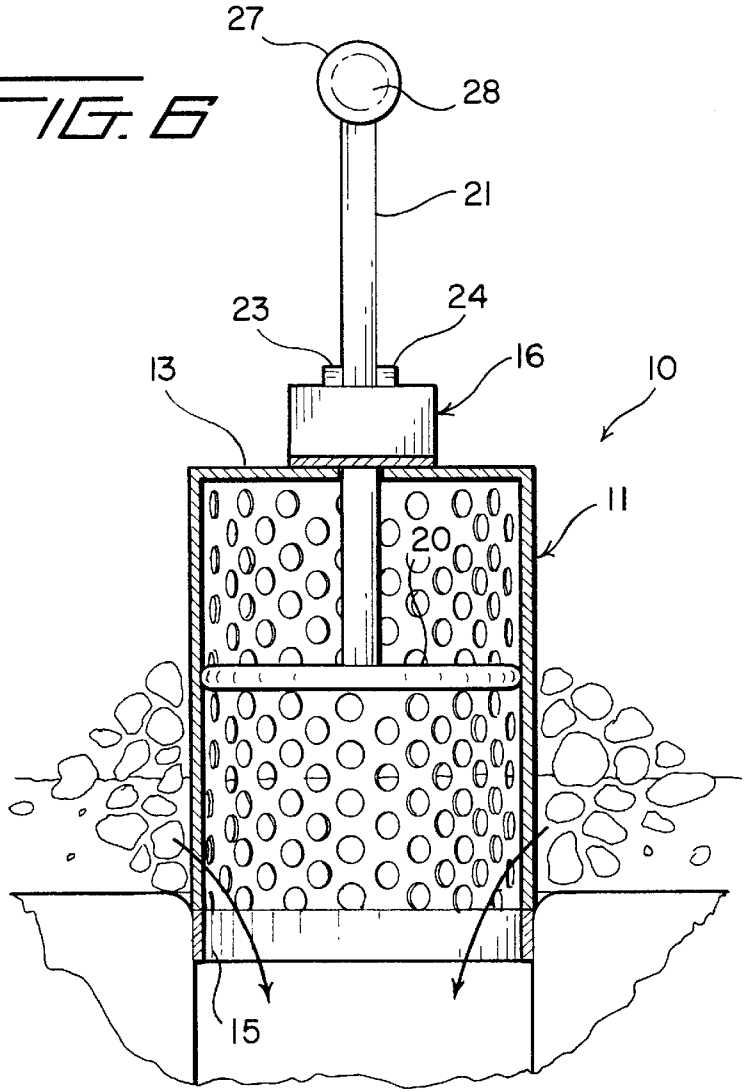
FIG. 6 is a view similar to FIG. 5, but with the strainer housing shown rotated about its longitudinal axis 90° from the position shown in FIG. 5, and showing the valve stopper supported in its raised, open position.
Figure 5:
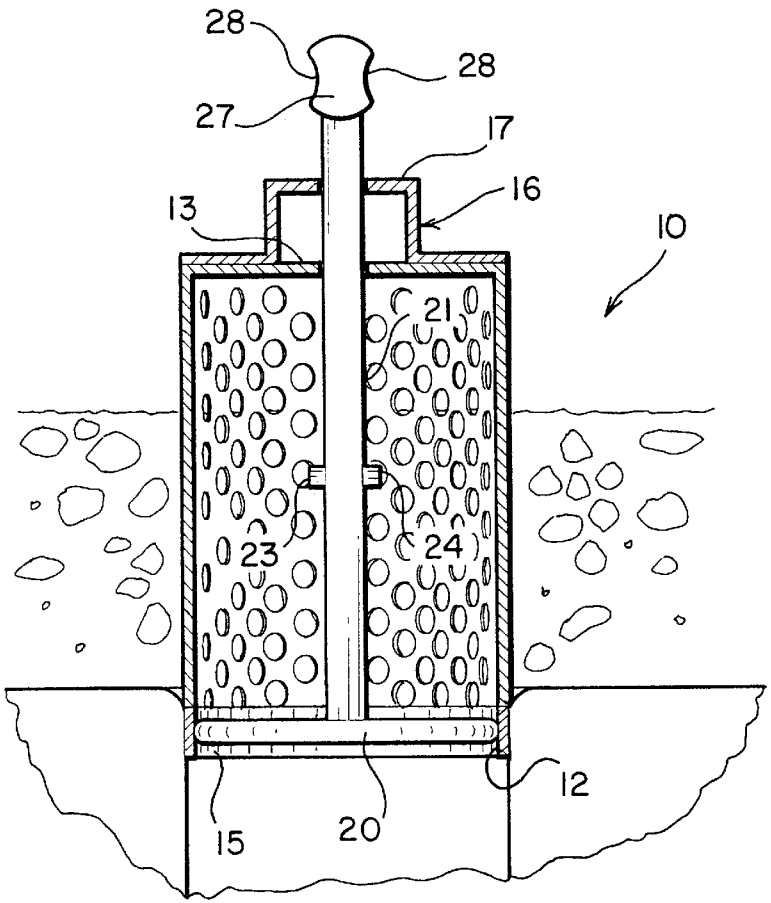
FIG. 5 is a somewhat schematic side view of the combined strainer and stopper of the invention in place in the drain opening of a basin, sink or other structure, with the valve stopper in a lowered, closed position to retain water in the basin.

A valve disc 20 is reciprocable within the housing into and out of sealing engagement with the valve seat 15 (shown closed in FIG. 5 and open in FIG. 6). An actuator stem 21 is connected at its lower end with the valve disc, and extends at its upper end through an opening 22 in the raised midportion 17 of the handle. A pair of retaining lugs 23 and 24 project outwardly from diametrically opposite sides of the stem, and a pair of slots 25 and 26 are formed on opposite sides of the opening 22 for cooperation with the lugs. That is, when the stem is rotated to align the lugs with the slots, the stem may be moved axially through the opening, and when the stem is raised to move the lugs upwardly through the slots and then rotated, the lugs rest on top of the midportion of the handle to retain the stem and valve disc in a raised, open position. A knob 27 may be provided on the upper end f the actuator stem to facilitate raising and lowering it, and rotating it to position the retaining lugs as desired. In this regard, a suitable roughened surface, or depressions 28, may be provided in the knob to prevent the fingers from slipping on the knob during use.

As shown best in FIGS. 5 and 6, in use the combined strainer and stopper 10 is inserted at its lower end in the drain opening D so that the strainer extends upwardly into the basin or sink. If the knob 27 and actuator stem 21 are pushed downwardly to position the valve disc 20 against the annular valve seat 15, water W may be introduced into the basin, where it will be retained. The large area of the strainer located within the water enables a substantial amount of debris 30 to collect without obstructing the strainer. Subsequently, when the actuator is moved upwardly to move the valve disc away from the seat, water is enabled to flow from the basin through the strainer and into the drain, while the debris is retained in the basin.

In one specific construction, the housing has a diameter of approximately three and one-eighth inches and length of approximately five and one-quarter inches, with uniformly spaced circular openings throughout of approximately one-eighth inch diameter. The imperforate lower end that defines the valve seat extends over approximately one-quarter inch of the length of the housing from the lower end thereof.

Although specific dimensions have been given above for a particular embodiment of the invention, it should be understood that the invention can have other shapes and sizes. Further, the housing may be made of any suitable material, with stainless steel being preferred.

While particular embodiments of the invention have been illustrated and described in detail herein, it should be understood that various changes and modifications may be made to the invention without departing from the spirit and intent of the invention as defined by the scope of the appended claims.

What is claimed is:

1. A combined strainer and stopper, comprising:

an elongate, tubular, perforate housing having an open lower end and a perforate top wall;

an annular valve seat formed on an inner surface of said lower end;

a fixed handle on said upper end, said handle having an upstanding midportion with an opening extending therethrough;

a stopper valve reciprocable in the housing into and out of sealing engagement with the valve seat; and a valve actuator stem connected at a lower end with the stopper valve and extending at an upper end through the opening in the handle for moving the stopper valve into and out of engagement with the valve seat, said housing adapted to be inserted at its lower end into a drain opening so that the housing is supported in an upright position extending upwardly from the drain opening.

2. A combined strainer and stopper as claimed in claim 1, wherein:

the valve seat is an annular, cylindrical, inner surface portion on the lower end of the housing.

3. A combined strainer and stopper as claimed in claim 2, wherein:

at least one outwardly projecting retaining lug is formed on an outer surface of the actuator stem; and at least one slot extends outwardly from an edge of said opening through the handle, said lug adapted to pass through the slot when the actuator stem is in one rotational position, and to lie on top of the handle to retain the actuating stem and stopper valve in an upward open position when the lug is moved upwardly through the slot and the actuator stem is rotated to a second rotational position.

4. A combined strainer and stopper as claimed in claim 2, wherein:

the stopper valve comprises a circular disc of resilient material adapted to slide in sealing relationship to said valve seat.

5. A combined strainer and stopper as claimed in claim 4, wherein:

at least one outwardly projecting retaining lug is formed on an outer surface of the actuator stem; and at least one slot extends outwardly from an edge of said opening through the handle, said lug adapted to pass through the slot when the actuator stem is in one rotational position, and to lie on top of the handle to retain the actuating stem and stopper valve in an upward open position when the lug is moved upwardly through the slot and the actuator stem is rotated to a second rotational position.

6. A combined strainer and stopper as claimed in claim 1, wherein:

at least one outwardly projecting retaining lug is formed on an outer surface of the actuator stem; and at least one slot extends outwardly from an edge of said opening through the handle, said lug adapted to pass through the slot when the actuator stem is in one rotational position, and to lie on top of the handle to retain the actuating stem and stopper valve in an upward open position when the lug is moved upwardly through the slot and the actuator stem is rotated to a second rotational position.

* * * * *